US006685131B1

(12) United States Patent
Zimmer

(10) Patent No.: US 6,685,131 B1
(45) Date of Patent: Feb. 3, 2004

(54) JIG FOR WEB TREATMENT

(76) Inventor: Roland J. P. Zimmer, P.O. Box 5561, Spartanburg, SC (US) 29304

( * ) Notice: Subject to any disclaimer, the term of this patent is extended or adjusted under 35 U.S.C. 154(b) by 0 days.

(21) Appl. No.: 10/286,218

(22) Filed: Nov. 1, 2002

(51) Int. Cl.[7] ..... B65H 18/10; D06B 3/10

(52) U.S. Cl. ..... 242/538.2; 242/534.1; 242/599.3; 68/180; 8/151

(58) Field of Search ..... 242/538.2, 538.3, 242/534.1, 599.3, 563.1; 68/180; 8/151

(56) References Cited

U.S. PATENT DOCUMENTS 2,056,071 A * 9/1936 Moore ..... 242/599.3
3,642,222 A * 2/1972 Leysinger ..... 242/534.1
5,664,890 A 9/1997 Nowak et al. ..... 284/282
5,758,376 A 6/1998 Meyer et al. ..... 8/149.1
6,145,783 A * 11/2000 Kim ..... 242/538.2
6,536,704 B1 * 3/2003 Rautakorpi et al. ..... 242/534.1

OTHER PUBLICATIONS

Zimmer USA Jig–Matic Sales Brochure.

* cited by examiner

*Primary Examiner*—John M. Jillions

(57) ABSTRACT

A jig adapted for atmospheric as well as heated and pressurized treatment of web material. The jig incorporates an arrangement of self lubricating and self aligning bearings disposed in supporting relation at the ends of roller shafts. At least one roller within the jig is adapted to be oscillated in an axial direction.

18 Claims, 5 Drawing Sheets

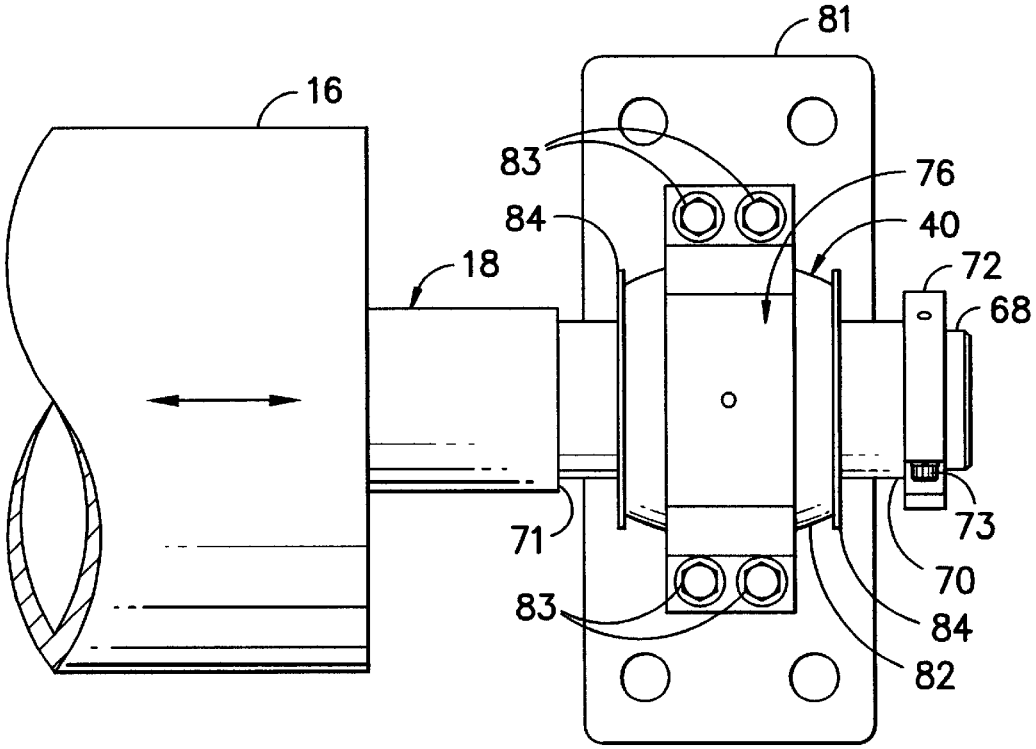
FIG. –5A–
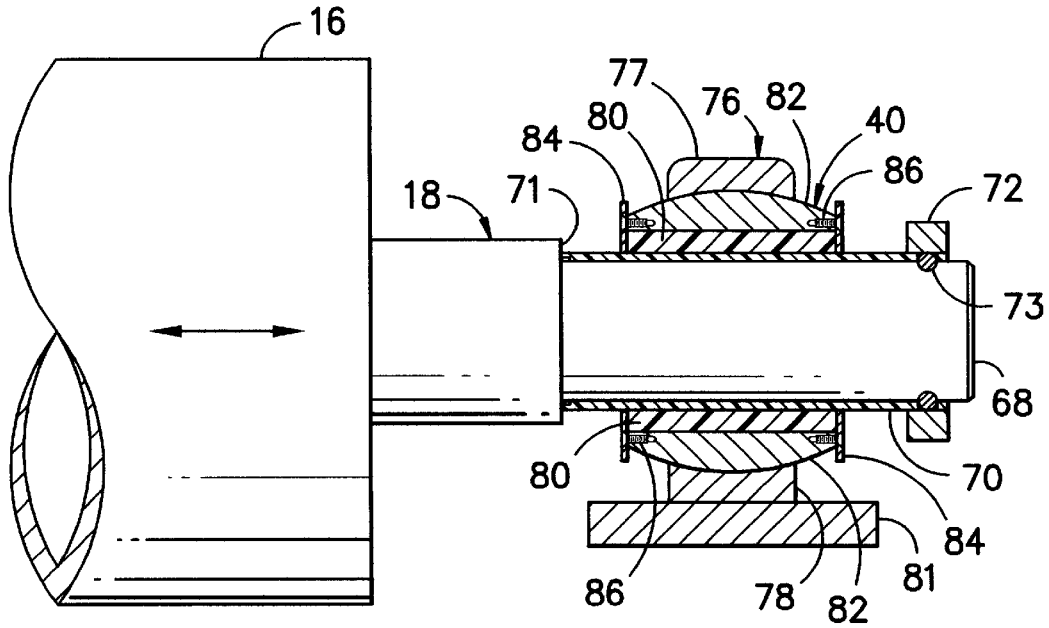
FIG. –5B–

JIG FOR WEB TREATMENT

TECHNICAL FIELD

The present invention relates to a jig type treatment apparatus and more particularly to a jig type textile dyeing apparatus. The apparatus incorporates an axially oscillating roller for staggered winding and unwinding of a fabric web. A self lubricating and self aligning bearing assembly adapted for use in supporting relation along the oscillating roller and other cooperating rollers is also provided. The jig type dyeing apparatus of the present invention is particularly well suited to high temperature pressurized dyeing applications treating large rolls of fabric although it is likewise suitable for other bath treatment procedures including bleaching, soaping, and the like.

BACKGROUND OF THE INVENTION

A jig operates by rolling out a piece of rolled-up fabric disposed around a first roller and causing the fabric to pass through a heated treatment bath such as a dye bath or the like and collecting the treated fabric on a second cooperating roller. Once the fabric has been passed through the treatment bath and collected on the second roller, the travel direction is reversed so that the fabric is built up again on the first roller with the fabric continuing to pass through the treatment bath. The jig typically has various control members to carry out functions during the treatment such as reversing the direction of rotation of the rollers, stopping operation after a predefined selected number of passes, regulating the speed of the rollers, regulating the tension of the fabric and the like.

A general benefit of a jig type treatment system resides in the ability to treat large quantities of fabric using a relatively small volume of bath solution thus providing substantial savings in water and energy. Moreover, due to the ability to carry out as many or as few exposure cycles as desired, the overall level of treatment may be varied as desired thereby providing the user with a substantial degree of freedom in the treatment process.

While traditional jig type dyeing machines have proven to be highly useful they have nonetheless faced certain difficulties arising from the closed environment of treatment and relatively little space available therein. One problem which has been identified in the past arises from the general construction of the fabrics which are treated. In particular, woven fabrics are typically formed with some of type of finished edge extending in the length dimension of the fabric along both sides of the fabric. Such finished edges are utilized to promote the integrity of the formed fabric so as to prevent an unraveling of the yarns forming the fabric along the edges. As will be appreciated, the finished edges give rise to a very slight increase in thickness at the edge. While the increased thickness is not generally noticeable when the fabric is in a flat condition, when the fabric is arranged into a multi-layer roll form the increased thickness along the edges may give rise to a pronounced variation in roll thickness between the edge of the roll and the interior portion of the roll. The fabric roll may thereby take on a so called "dog bone" geometry along its length. This dog bone geometry becomes more pronounced as the size of the fabric roll is increased and correspondingly is diminished as the size of the roll is decreased. Thus, in a jig type treatment apparatus the shape of the fabric rolls may vary substantially during different stages of treatment as the fabric is passed from one roller to the other. In extreme circumstances, this variation in the geometry may negatively influence the uniformity of exposure of the fabric web to the treatment bath during the treatment cycle and may thereby influence the uniformity of final coloration.

Aside from the difficulties arising from the variations in roll profile the actual environment of the treatment apparatus may give rise to difficulties in maintaining a substantially smooth winding and unwinding of the fabric between the rollers. In particular, the rollers which carry the fabric must be rotated in a lubricated environment so as to substantially avoid any irregularity in rotation. However, due to the closed high temperature environment of operation, it is difficult to deliver appropriate lubrication to the rotating roll elements without undue complexity. Moreover, difficulties in maintaining lubrication may arise due to wear and/or displacement which impact the position of the roller shaft during operation over the life of the jig.

SUMMARY OF THE INVENTION

According to one aspect of the invention, a jig dyeing machine is provided which is adapted for use in either atmospheric or high pressure/temperature conditions and which incorporates at least one axially displaceable roller for supporting and transporting fabric during the treatment process. The axially displaceable roller is oscillated back and forth transverse to the path of fabric movement during the treatment process without requiring substantial movement of supporting structural elements.

According to another aspect of the invention, a jig dyeing machine is provided which is adapted for use in either atmospheric or high pressure/temperature conditions and in which cooperating rollers which take up and let off the fabric during the treatment process may be carried within self lubricating and self aligning bearings mounted at either end of the rollers thereby eliminating any need for lubrication devices.

BRIEF DESCRIPTION OF THE DRAWINGS

The following drawings which are incorporated in and which constitute a part of this specification illustrate an exemplary embodiment of the present invention and, together with the general description provided above and the detailed description set forth below, serve to explain the principles of the invention wherein:

FIG. 5A is an elevation view of an axially displaceable roller with a supporting shaft carried within a self aligning and self lubricating bearing assembly; and FIG. 5B is a cut-away side view of an axially displaceable roller carried on a roller shaft in sliding relation within a self aligning and self lubricating bearing assembly.

While the invention has been illustrated and generally described above and will hereinafter be described in connection with certain potentially preferred embodiments and procedures, it is to be understood and appreciated that in no event is the invention to be limited to such illustrated and described embodiments and procedures. On the contrary, it is intended that the present invention shall extend to all alternatives and modifications as may embrace the broad principles of this invention within the true spirit and scope thereof.

DESCRIPTION OF THE PREFERRED EMBODIMENTS

Figure 1:
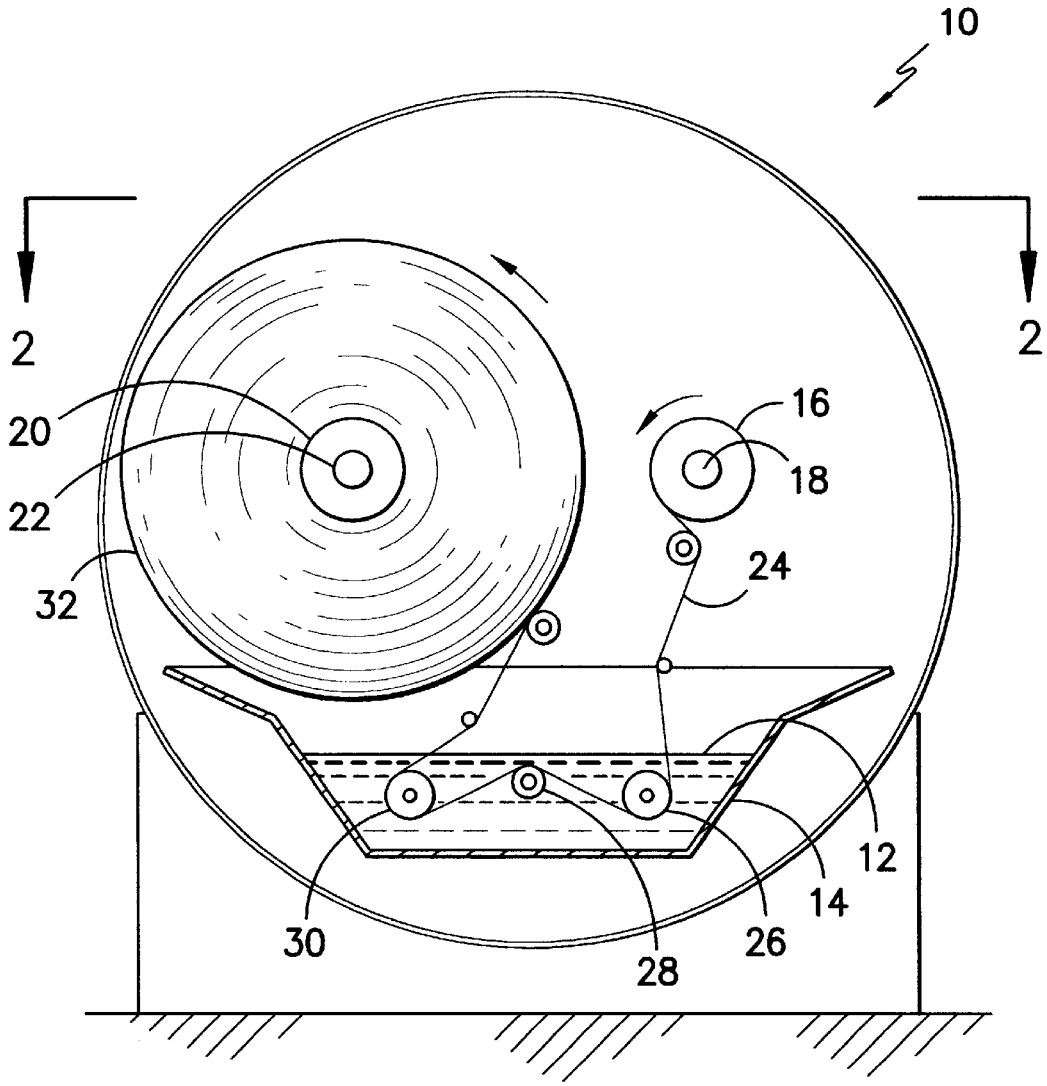
FIG. 1 is a schematic cut-away end view of a jig dyeing machine according to the present invention.

Reference will now be made to the drawings wherein like reference numerals are used to designate corresponding components throughout the various views. In FIG. 1 there is illustrated a jig dyeing machine 10 for use in rolling a fabric in and out of a dye bath 12 held within a containment trough 14. As illustrated schematically, the jig dyeing machine 10 includes a first roller 16 supported along a first roller shaft 18 and a second roller 20 supported along a second roller shaft 22.

As shown, fabric 24 is fed between the first roller 16 and the second roller 20 in a travel path through the containment trough 14. The travel path includes an arrangement of guide rollers 26, 28, 30 mounted within the containment trough 14. The axes of the guide rollers extend in substantially in the same direction as the first roller 16 and the second roller 20. In the exemplary configuration illustrated, two of the guide rollers 26, 30 are located at a height below the intermediate guide roller 28 so as to increase the period of contact between the fabric 24 and the dye bath 12 within the containment trough 14. However, it is to be understood that any alternative arrangement for the fabric guide path may likewise be utilized if desired. By way of example only, and not limitation, the intermediate guide roller 28 may be replaced with a vacuum box or the like if desired to further facilitate dye treatment.

In FIG. 1, the fabric 24 is illustrated has having traveled through substantially one complete transfer between the first roller 16 and the second roller 20. That is, the fabric 24 has been substantially unwound from the first roller 16 and collected on the second roller 20. The fabric 24 thus defines a multi-layered fabric roll 32 which is collected around the second roller 20. According to a potentially preferred practice, the jig dyeing machine 10 may be operated at a substantially elevated temperature and pressure in a manner as will be well known to those of skill in the art. Such pressurized heated impregnation of the fabric 24 within the dye bath 12 may facilitate more rapid and uniform dye reaction.

As will be appreciated, once the fabric 24 has been passed from the first roller 16 through the dye bath 12 and onto the second roller 20, the direction of roller rotation is reversed such that the rollers 16, 20 rotate in the opposite direction. Motors 60, 60' (FIG. 2) power such rotation. The speed of the rollers 16, 20 is regulated so as to accommodate the relative changes in the diameter of the fabric rolls surrounding the rollers 16, 20 in order to ensure that the fabric 24 moves through the dye bath 12 at a substantially constant rate as the process continues.

Figure 2:
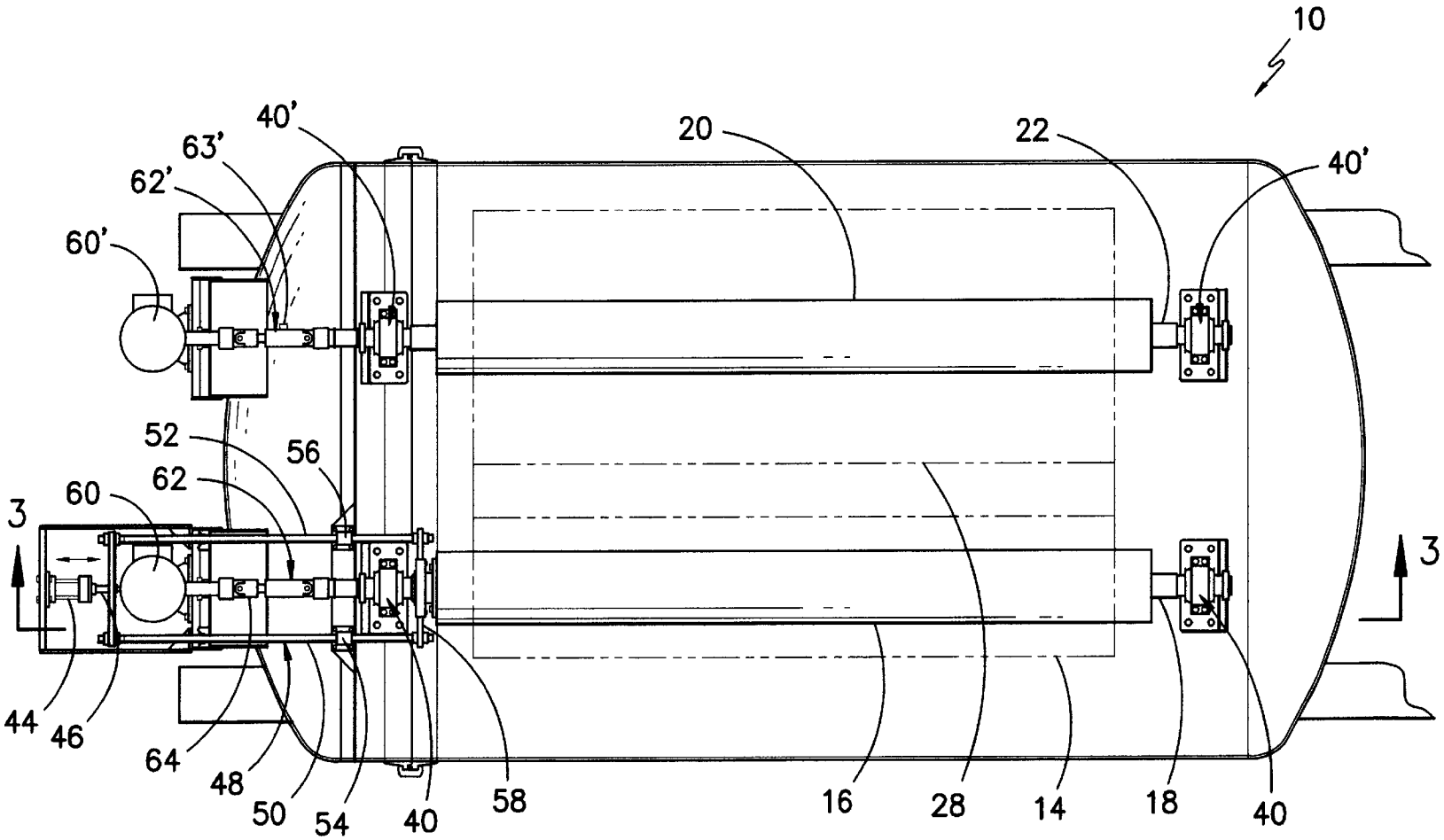
FIG. 2 is a schematic cut-away top view of a jig dyeing machine according to the present invention taken generally along line 2—2 in FIG. 1.
Figure 3:
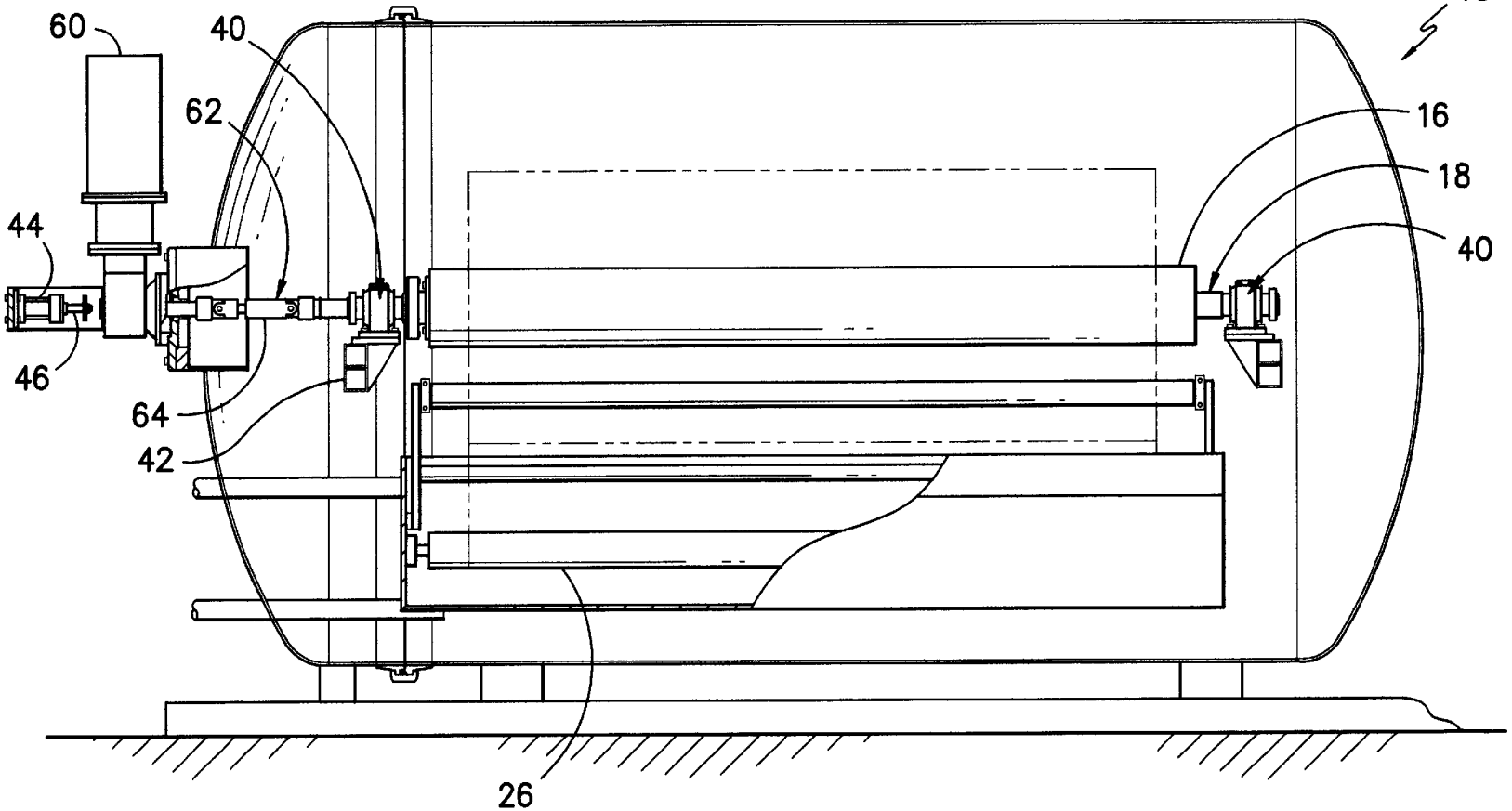
FIG. 3 is a schematic cut-away side view of a jig dyeing machine according to the present invention taken generally along line 3—3 in FIG. 2.

Referring simultaneously to FIGS. 2 and 3, cut-away top and side views of the jig dyeing machine 10 are illustrated. The first roller 16 is mounted such that the first roller shaft 18 is held in sliding axial relation to a pair of bearings 40 mounted at either end of the first roller shaft 18. As illustrated, the bearings 40 supporting the first roller shaft 18 are preferably mounted on a stationary platform 42 (FIG. 4) such that the bearings 40 remain in a substantially stationary position with relative movement taking place by axial oscillation of the first roller shaft 18. That is, the bearings 40 remain fixed while the roller shaft 18 carries the roller 16 axially relative to the bearings 40.

Figure 4:
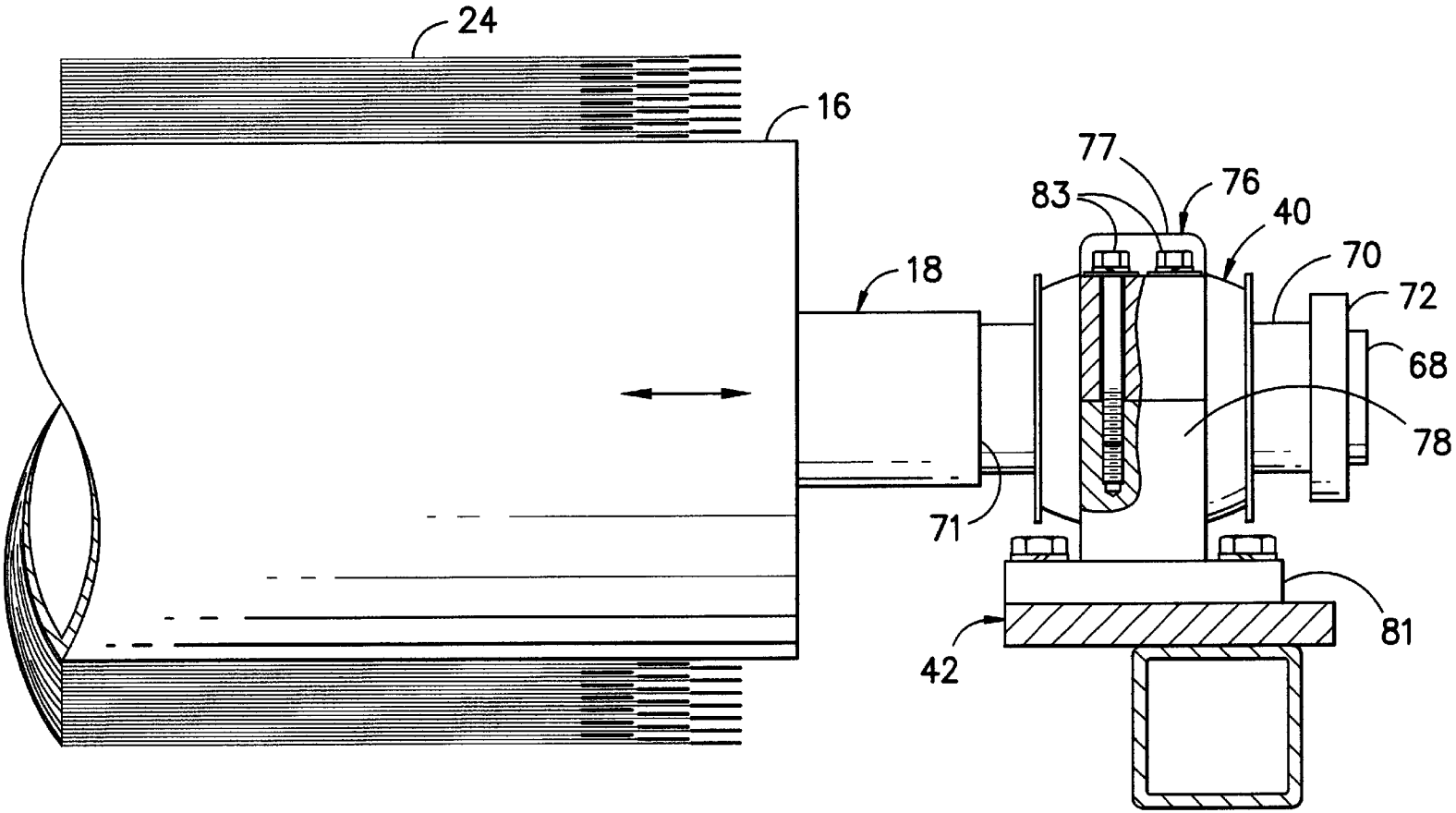
FIG. 4 is a detailed view of one end of an oscillating roller and self lubricating bearing assembly illustrating a staggered fabric edge.

As best illustrated FIG. 4 the lateral axial movement of the first roller 16 during operation causes the edge of the fabric 24 to undergo a slight displacement during the winding and unwinding process thereby giving rise to a staggered edge configuration. As will be appreciated, such a staggered edge configuration prevents the development of a substantially dog bone shaped fabric roll thereby promoting uniformity of treatment as the fabric 24 is passed through the dye bath 12.

The oscillation of the first roller 16 is preferably carried out substantially without requiring the movement of any support or drive elements associated with the operation of the first roller 16. According to the illustrated exemplary construction, a power cylinder 44 is operatively connected to the first roller shaft 18 such that extension and retraction of a piston element 46 transfers axial movement to the first roller shaft 18. In the illustrated embodiment, extension of the piston element 46 pushes the first roller shaft 18 away from the power cylinder 44 and retraction of the piston element 46 pulls the roller shaft towards the power cylinder 44. However, it will be appreciated that this arrangement may also be reversed if desired such as by mounting the power cylinder 44 at an appropriate location facing in the reverse direction. Of course, movement of the first roller shaft 18 corresponds to a like movement of the surrounding first roller 16 upon which the fabric 24 is carried.

According to the illustrated construction, the movement of the first roller shaft 18 and surrounding first roller 16 may be carried out substantially without requiring movement of associated power structure or support elements. In particular, in the illustrated arrangement, the piston element 46 is operatively connected to a rod assembly 48 including a pair of lateral rods 50, 52 extending in sliding relation through corresponding hollow guides 54, 56. As shown, the distal ends of the lateral rods 50, 52 are connected via a distal cross member 58 to one end of the first roller shaft 18. Thus, operative and structural members such as the drive motor 60 are disposed between the lateral rods 50, 52 so as to permit the rod assembly 48 to be shifted in the axial direction of the first roller shaft 18 without requiring movement of the drive motor 60 or the structural elements (including the bearings 40) supporting the first roller shaft 18. Due to relatively limited space availability, it is contemplated that the lateral shifting movement of the first roller shaft 18 will preferably be in the order of several inches corresponding to the stroke of the piston element 46. By way of example only, and not limitation, a lateral shift in the range of about 1.5 to about 4 inches and more preferably about 2.5 inches may be desired.

As will be appreciated, as the rod assembly 48 is used to push and pull the first roller shaft 18 in the axial direction of the first roller shaft 18, the distance between the drive motor 60 and the first roller shaft 18 will change by a distance substantially equivalent to the stroke of movement. In order to accommodate the change in distance between the drive motor 60 and the first roller shaft 18 during the stroking movement, an adjustable length drive shaft assembly 62 is used to establish an operative driving connection between the drive motor 60 and the first roller shaft 18. According to the illustrated and potentially preferred arrangement, the drive shaft assembly 62 incorporates a universal joint structure 64 such as a Curtis Universal Joint available from the Curtis Universal Joint Company located in Springfield, Mass. USA. As will be appreciated, such a universal joint structure permits the drive shaft assembly 62 to undergo a degree of variation by bending between the segments of the universal joint structure while nonetheless maintaining rotational movement through the drive shaft assembly 62. If desired, a degree of longitudinal extension and shortening of the drive shaft assembly 62 may also be permitted by such a structure. Accordingly, when the rod assembly 48 is shifted so as to place the drive shaft assembly 62 into compression, the drive shaft assembly 62 may undergo a degree of shortening and coordinated buckling out of the plane of the drawing such that the required operating length is achieved. The drive motor 60 can thus remain stationary while maintaining driving power to the first roller shaft 18.

The use of the universal joint structure 64 provides the advantage of adapting to changes in the position of the attached roller shaft during the life of the jig. In particular, as the roller shaft 18 and/or elements supporting the roller shaft 18 undergo changes due to factors such as settling and wear, the alignment height of the roller shaft may change slightly. The flexibility of the universal joint structure 64 within the drive shaft assembly 62 readily accommodates such changes thereby avoiding undue stress on the system.

As illustrated, the first roller shaft 18 is preferably mounted within the bearings 40 at reduced diameter hub portions 68 forming part of the first roller shaft 18. In this regard it is to be understood that the reduced diameter hub portions 68 may be either integral with the first roller shaft 18 or may be separate attached elements. In either event, the diameter of the hub portion 68 is selected so as to ride within a bearing sleeve 70 of wear resistant material carried at the interior of the bearings 40. As illustrated, the bearing sleeve 70 may be bounded on the inboard side by a shoulder 71 at the position where the first roller shaft 18 necks down to the reduced diameter hub portion 68. The bearing sleeve 70 may be bounded on the outboard side by a collar 72 such as a split ring collar or the like held together by a pair of collar pins 73 carried within mating grooves at the end of the reduced diameter hub portion 68. Thus, as the first roller shaft 18 is oscillated in an axial direction, the reduced diameter hub portion 68 and overlying bearing sleeve can move in sliding relation through the bearing 40. At the same time, the bearing sleeve 70 remains in place relative to the reduced diameter hub portion 68. Excessive movement is blocked by the shoulder 71 and the collar 72.

According to the illustrated arrangement, the second roller shaft 22 and associated surrounding roller 20 preferably remain substantially fixed in axial relation between a pair of opposing bearings 40' disposed at a fixed position at either end of the second roller shaft 22. As best illustrated in FIG. 2, the second roller shaft 22 is operatively connected to motor 60' by a drive shaft 62' incorporating a universal joint assembly as previously described but including a set pin 63' to substantially fix the operating longitudinal dimension of the drive shaft 62' while nonetheless maintaining a degree of flexibility to accommodate alignment changes within the second roller shaft over time. In such an arrangement the relative movement between the first roller 16 and the second roller 20 is controlled by the axial movement of the first roller 16. Of course, if desired, the second roller shaft 22 could also be made to oscillate in an axial direction by use of an assembly similar to that illustrated and described in relation to the first roller shaft 18.

Referring simultaneously to FIGS. 4, 5A and 5B, a self lubricating and self aligning bearing assembly suitable for use with both the axially displaceable first roller shaft 18 as well as the fixed axial position second roller shaft is illustrated in detail. Accordingly, while the bearing assembly is illustrated in relation to the axially displaceable first roller shaft 18 and the associated bearings 40, the illustrated assembly is likewise used in relation to the axially fixed second roller shaft 22 and its associated bearings 40'.

As previously indicated, the bearings 40, 40' are preferably held in a substantially fixed position which does not move. In the illustrated bearing assembly arrangement, this fixed position is maintained by a pillow block 76 of split construction extending circumferentially around the bearings 40. As shown, the pillow block 76 includes an upper half ring segment 77 and a lower half ring segment 78. The upper and lower half ring segments 77, 78 are affixed to one another on either side by removable bolts 83 or the like to permit access to the bearing 40. As illustrated, the lower half ring segment 78 may include an outwardly projecting base 81 in the form of a plate structure for bolted attachment to a suitable support platform 42 (FIG. 4).

In the illustrated arrangement, the bearings 40 include a bushing 80 disposed in contacting surrounding relation to the bearing sleeve 70 which is disposed around the reduced diameter hub portion 68. According to the potentially preferred practice, the bushing 80 is formed from a self lubricating material such as a self lubricating polyimide graphite-fiber composite material. One such material is believed to be available from GRAPHALLOY Products having a place of business in Yonkers, N.Y., USA. By way of example only, and not limitation, the use of such materials in various bushing assemblies is illustrated and described in U.S. Pat. No. 5,664,890 to Nowak et al. the teachings of which are incorporated by reference as if fully set forth herein. Of course, other suitable self lubricating materials may also be used if desired. The bearing sleeve 70 is preferably formed of material having a highly wear resistant and smooth outer surface so as to minimize wear. One such material is a hardened chrome alloy material although other materials such as heat treated steel with a smooth surface or the like may also be used if desired.

Due to the fact that the bearing sleeve 70 is held in fixed surrounding relation to the hub portion 68, frictional wear is substantially localized at the interface between the bushing 80 and the bearing sleeve 70. In this regard it is to be understood that the hard, smooth surface of the bearing sleeve 70 substantially protects the bearing sleeve 70 and underlying hub portion 68 against degradation. Thus, wear is substantially isolated within the bushing 80 which may be easily replaced as needed.

In addition to the bearing sleeve 70 and overlying bushing 80, the bearings preferably also include a housing portion 82 which preferably has a substantially curved barrel shaped outer surface around a flat interior surface mated to and contacting the outer surface of the bushing 80. It is believe that the curved outer surface of the housing 82 provides a substantial benefit by promoting self alignment of the bearings 40 even if an irregularity develops in the hub portion 68 of the roller shaft 18 or in some other element within the overall structure. That is, pressure applied across the curved outer surface of the housing 82 causes that element to seek an equilibrium position relative to lower surface structures.

In order to contain the elements forming the bearings 40, an annular bushing covering ring 84 is attached via bolts 86 or other attachment elements to either end of the assembly forming the bearings. Thus, the elements of the bearings 40 are contained at a substantially fixed position within the jig dyeing machine while nonetheless permitting the rotation of the hub portion 68 and attached sleeve element 70 relative to the bearings 40.

It is to be understood that while the present invention has been illustrated and described in relation to potentially preferred embodiments, constructions and procedures, that such embodiments, constructions and procedures are illustrative and exemplary only and that the present invention is in no event to be limited thereto. Rather it is contemplated that modifications and variations embodying the principles of the present invention will in no doubt occur to those skilled in the art. It is therefore intended that the present invention shall extend to all such modifications and variations as may incorporate the broad principles of the present invention within the full spirit and scope thereof.

What is claimed is:

1. A jig adapted for atmospheric as well as heated and pressurized treatment of web material, the jig comprising:

a first rotating roller including a web carrying segment and a substantially concentrically disposed first roller shaft assembly including portions projecting outboard of the web carrying segment, and wherein the portions of the first roller shaft assembly projecting outboard of the web carrying segment include reduced diameter hub portions adapted to engage self lubricating and self aligning bearing assemblies disposed at either end of the first roller shaft assembly, and wherein the first rotating roller shaft assembly is supported in axially sliding relation within the self lubricating and self aligning bearing assemblies disposed at either end of the first roller shaft assembly, at least one of the self lubricating and self aligning bearing assemblies disposed at either end of the first roller shaft assembly comprising a sleeve element of substantially smooth wear resistant material disposed in substantially fixed position around one of the reduced diameter hub portions such that axial and rotational movement of the first roller shaft assembly is translated to the sleeve element, said at least one of the self lubricating and self aligning bearing assemblies disposed at either end of the first roller shaft assembly further comprising a bushing of self lubricating material, wherein the bushing has a length shorter than the sleeve element, and a bushing housing being disposed at least partially around the bushing, the bushing housing having a substantially curved outer surface and a substantially planar inner surface disposed in opposing relation to the bushing, the bushing and surrounding housing being held by a pillow block support at a substantially fixed position within the jig such that axial and rotational movement of the first roller shaft assembly is not translated to the bushing;

at least a second rotating roller adapted to accept the web material from the first rotating roller;

a power cylinder including a selectively displaceable rod element operatively connected to the first roller shaft assembly, wherein the power cylinder is adapted to translate movement of the selectively displaceable rod element to the first roller shaft assembly such that upon extension and retraction of the displaceable rod element the first roller shaft assembly is oscillated in an axial direction; and a first rotation inducing drive assembly comprising a substantially stationary motor and a drive shaft disposed in operative connection between the motor and the first roller shaft assembly, said drive shaft comprising at least one universal joint assembly such that upon axial movement of the first roller shaft assembly the operative length of the drive shaft is varied whereby an operative connection is maintained between the motor and first roller shaft assembly without movement of the motor or the bearing assemblies disposed at either end of the first roller shaft assembly.

2. A jig as recited in claim 1, wherein the sleeve element is disposed in a substantially fixed axial position along said one of the reduced diameter hub portions between an inboard shoulder portion of the first roller shaft assembly and an outboard collar assembly, such that the inboard shoulder portion and the outboard collar assembly are spaced away from the bushing housing with open space along the sleeve element between the bushing housing and at least one of the inboard shoulder portion and the outboard collar assembly such that the inboard shoulder portion and the outboard collar assembly confine sliding movement of the first roller shaft assembly to a limited predefined distance.

3. A jig as recited in claim 2, wherein the outboard collar assembly comprises a split ring and an arrangement of connecting pins engaging the sleeve element such that the collar assembly clamps the sleeve element in place relative to said one of the reduced diameter hub portions.

4. A jig as recited in claim 1, wherein the sleeve element comprises a hardened metal.

5. A jig as recited in claim 1, wherein the bushing comprises a composite material incorporating a graphite constituent.

6. A jig as recited in claim 1, wherein the sleeve element comprises a hardened chrome alloy and the bushing comprises a composite material incorporating a graphite constituent.

7. A jig as recited in claim 1, wherein the selectively displaceable rod element is operatively connected to the first roller shaft assembly by a sliding carrier disposed between the first roller shaft assembly and the power cylinder.

8. A jig as recited in claim 7, wherein the sliding carrier is of a substantially rectangular configuration comprising a pair of rod elements disposed in supported sliding relation within travel guide structures with crossing members at ends of the rod elements operatively connected to the selectively displaceable rod element and the first roller shaft assembly.

9. A jig adapted for atmospheric as well as heated and pressurized treatment of web material, the jig comprising:

a first rotating roller including a web carrying segment and a substantially concentrically disposed first roller shaft assembly including portions projecting outboard of the web carrying segment, and wherein the portions of the first roller shaft assembly projecting outboard of the web carrying segment include reduced diameter hub portions adapted to engage self lubricating and self aligning bearing assemblies disposed at either end of the first roller shaft assembly, and wherein the first rotating roller shaft assembly is supported in axially sliding relation within the self lubricating and self aligning bearing assemblies disposed at either end of the first roller shaft assembly, at least one of the self lubricating and self aligning bearing assemblies disposed at either end of the first roller shaft assembly comprising a sleeve element of substantially smooth wear resistant material disposed in substantially fixed position around one of the reduced diameter hub portions such that axial and rotational movement of the first roller shaft assembly is translated to the sleeve element, said at least one of the self lubricating and self aligning bearing assemblies disposed at either end of the first roller shaft assembly further comprising a bushing of self lubricating material, wherein the bushing has a length shorter than the sleeve element, and a bushing housing being disposed at least partially around the bushing, the bushing housing having a substantially curved outer surface and a substantially planar inner surface disposed in opposing relation to the bushing, the bushing and surrounding housing being held by a pillow block support at a substantially fixed position within the jig such that axial and rotational movement of the first roller shaft assembly is not translated to the bushing;

at least a second rotating roller adapted to accept the web material from the first rotating roller, wherein the second rotating roller includes a web carrying segment and a substantially concentrically disposed second roller shaft assembly including portions projecting outboard of the web carrying segment, and wherein the portions of the second roller shaft assembly projecting outboard of the web carrying segment include reduced diameter hub portions adapted to engage self-lubricating and self aligning bearing assemblies disposed at either end of the second roller shaft assembly, and wherein the second rotating roller shaft assembly is supported in a substantially fixed axial relation within the self-lubricating and self aligning bearing assemblies disposed at either end of the second roller shaft assembly;

a power cylinder including a selectively displaceable rod element operatively connected to the first roller shaft assembly, wherein the power cylinder is adapted to translate movement of the selectively displaceable rod element to the first roller shaft assembly such that upon extension and retraction of the displaceable rod element the first roller shaft assembly is oscillated in an axial direction; and a first rotation inducing drive assembly comprising a substantially stationary motor and a drive shaft disposed in operative connection between the motor and the first roller shaft assembly, said drive shaft comprising at least one universal joint assembly such that upon axial movement of the first roller shaft assembly the operative length of the drive shaft is varied whereby an operative connection is maintained between the motor and first roller shaft assembly without movement of the motor or the bearing assemblies disposed at either end of the first roller shaft assembly.

10. A jig as recited in claim 9, wherein at least one of the self lubricating and self aligning bearing assemblies disposed at either end of the second roller shaft assembly comprises a sleeve element of substantially smooth wear resistant material disposed in substantially fixed position around one of the reduced diameter hub portions such that rotational movement of the second roller shaft assembly is translated to the sleeve element, said at least one of the self lubricating and self aligning bearing assemblies disposed at either end of the second roller shaft assembly further comprising a bushing of self lubricating material disposed around the sleeve element and a bushing housing being disposed at least partially around the bushing, the bushing housing having a substantially curved outer surface and a substantially planar inner surface disposed in opposing relation to the bushing, the bushing and surrounding housing being held by a pillow block support at a substantially fixed position within the jig such that rotational movement of the second roller shaft assembly is not translated to the bushing.

11. A jig as recited in claim 10, wherein the sleeve element is disposed in a substantially fixed axial position along said one of the reduced diameter hub portions between an inboard shoulder portion of the second roller shaft assembly and an outboard collar assembly.

12. A jig as recited in claim 11, wherein the outboard collar assembly comprises a split ring and an arrangement of connecting pins engaging the sleeve element such that the collar assembly clamps the sleeve element in place relative to said one of the reduced diameter hub portions.

13. A jig as recited in claim 11, wherein the sleeve element comprises a hardened metal.

14. A jig as recited in claim 13, wherein the bushing comprises a composite material incorporating a graphite constituent.

15. A jig as recited in claim 9, further comprising a second rotation inducing drive assembly comprising a substantially stationary motor and a drive shaft disposed in operative connection between the motor and the second roller shaft assembly, said drive shaft comprising at least one universal joint assembly.

16. A Jig as recited in claim 9, wherein the selectively displaceable rod element is operatively connected to the first roller shaft assembly by a sliding carrier disposed between the first roller shaft assembly and the power cylinder.

17. A jig as recited in claim 16, wherein the sliding carrier is of a substantially rectangular configuration comprising a pair of rod elements disposed in supported sliding relation within travel guide structures with crossing members at ends of the rod elements operatively connected to the selectively displaceable rod element and the first roller shaft assembly.

18. A jig adapted for atmospheric as well as heated and pressurized treatment of a web material, the jig comprising:

a first rotating roller including a web carrying segment and a substantially concentrically disposed first roller shaft assembly including portions projecting outboard of the web carrying segment, and wherein the portions of the first roller shaft assembly projecting outboard of the web carrying segment include reduced diameter hub portions adapted to engage self lubricating and self aligning bearing assemblies disposed at either end of the first roller shaft assembly, and wherein the first rotating roller shaft assembly is supported in axially sliding relation within the self lubricating and self aligning bearing assemblies disposed at either end of the first roller shaft assembly, the self lubricating and self aligning bearing assemblies disposed at either end of the first roller shaft assembly each comprising a sleeve element of substantially smooth wear resistant material disposed in substantially fixed position around one of the reduced diameter hub portions such that axial and rotational movement of the first roller shaft assembly is translated to the sleeve element, said self lubricating and self aligning bearing assemblies disposed at either end of the first roller shaft assembly further comprising a bushing of self lubricating material, wherein the bushing has a length shorter than the sleeve element, and a bushing housing being disposed at least partially around the bushing, the bushing housing having a substantially curved outer surface and a substantially planar inner surface disposed in opposing relation to the bushing, the bushing and surrounding housing being held by a pillow block support at a substantially fixed position within the jig such that axial and rotational movement of the first roller shaft assembly is not translated to the bushing and wherein the sleeve element is disposed in a substantially fixed axial position along said one of the reduced diameter hub portions between an inboard shoulder portion of the first roller shaft assembly and an outboard collar assembly, such that the inboard shoulder portion and the outboard collar assembly are spaced away from the bushing housing such that the inboard shoulder portion and the outboard collar assembly confine sliding movement of the first roller shaft assembly to a limited predefined distance;

at least a second rotating roller including a web carrying segment and a substantially concentrically disposed second roller shaft assembly including portions projecting outboard of the web carrying segment, and wherein the portions of the second roller shaft assembly projecting outboard of the web carrying segment include reduced diameter hub portions adapted to engage self-lubricating and self aligning bearing assemblies disposed at either end of the second roller shaft assembly, and wherein the second rotating roller shaft assembly is supported in a substantially fixed axial relation within the self lubricating and self aligning bearing assemblies disposed at either end of the second roller shaft assembly, the self lubricating and self aligning bearing assemblies disposed at either end of the second roller shaft assembly each comprising a sleeve element of substantially smooth wear resistant material disposed in substantially fixed position around one of the reduced diameter hub portions such that rotational movement of the second roller shaft assembly is translated to the sleeve element, said self lubricating and self aligning bearing assemblies disposed at either end of the second roller shaft assembly further comprising a bushing of self lubricating material disposed around the sleeve element and a bushing housing being disposed at least partially around the bushing, the bushing housing having a substantially curved outer surface and a substantially planar inner surface disposed in opposing relation to the bushing, the bushing and surrounding housing being held by a pillow block support at a substantially fixed position within the jig such that rotational movement of the second roller shaft assembly is not translated to the bushing and wherein the sleeve element is disposed in a substantially fixed axial position along the reduced diameter hub portions between an inboard shoulder portion of the second roller shaft assembly and an outboard collar assembly;

a power cylinder including a selectively displaceable rod element operatively connected to the first roller shaft assembly, wherein the power cylinder is adapted to translate movement of the selectively displaceable rod element to the first roller shaft assembly such that upon extension and retraction of the displaceable rod element the first roller shaft assembly is oscillated in an axial direction;

a first rotation inducing drive assembly comprising a substantially stationary motor and a drive shaft disposed in operative connection between the motor and the first roller shaft assembly, said drive shaft comprising at least one universal joint assembly such that upon axial movement of the first roller shaft assembly the operative length of the drive shaft is varied whereby an operative connection is maintained between the motor and first roller shaft assembly without movement of the motor or the bearing assemblies disposed at either end of the first roller shaft assembly; and a second rotation inducing drive assembly comprising a substantially stationary motor and a drive shaft disposed in operative connection between the motor and the second roller shaft assembly, said drive shaft comprising at least one universal joint assembly.

* * * * *